US008529418B2

(12) United States Patent
Stewart et al.

(10) Patent No.: US 8,529,418 B2
(45) Date of Patent: Sep. 10, 2013

(54) BALANCE THERAPY SYSTEM

(75) Inventors: Duncan Stewart, Colorado Springs, CO (US); Thomas D. Meyer, Del Rio, TX (US); Travis J. Miller, Fort Walton Beach, FL (US); Holden D. Leute, Sheppard AFB, TX (US); Christopher M. Schroer, Miamisburg, OH (US)

(73) Assignee: Falconworks, Colorado Springs, CO (US)

( * ) Notice: Subject to any disclaimer, the term of this patent is extended or adjusted under 35 U.S.C. 154(b) by 542 days.

(21) Appl. No.: 12/758,506

(22) Filed: Apr. 12, 2010

(65) Prior Publication Data

US 2011/0039669 A1 Feb. 17, 2011

Related U.S. Application Data

(60) Provisional application No. 61/168,339, filed on Apr. 10, 2009.

(51) Int. Cl.
*A63B 22/16* (2006.01)

(52) U.S. Cl.
USPC ..... 482/146; 482/6; 482/51; 482/117; 273/449; 434/258; 463/7; 601/23

(58) Field of Classification Search
USPC ..... 600/587, 595; 482/51, 114–117, 482/146, 4–7; 472/48, 130, 135; 273/449, 273/DIG. 31; 601/23, 27–32; 434/46, 55, 434/258; 73/865.4; 473/269, 279; 463/7; 607/77, 78
See application file for complete search history.

(56) References Cited

U.S. PATENT DOCUMENTS

| | | | | | |
|---|---|---|---|---|---|
| 3,352,559 | A | * | 11/1967 | Larsen | 473/269 |
| 3,859,736 | A | * | 1/1975 | Hill et al. | 434/55 |
| 3,869,127 | A | * | 3/1975 | Kohori | 473/279 |
| 4,491,318 | A | | 1/1985 | Francke | |
| 4,548,289 | A | * | 10/1985 | Mechling | 600/587 |
| 4,850,588 | A | * | 7/1989 | Desjardins et al. | 482/51 |
| 5,112,045 | A | | 5/1992 | Mason et al. | |
| 5,271,416 | A | | 12/1993 | Lepley | |
| 5,337,757 | A | | 8/1994 | Jain et al. | |
| 5,358,251 | A | * | 10/1994 | Ashton | 473/269 |
| 5,368,536 | A | * | 11/1994 | Stodgell | 482/79 |
| 5,429,562 | A | * | 7/1995 | Milner | 482/51 |
| 5,431,406 | A | * | 7/1995 | Ishii | 248/396 |
| 5,470,074 | A | * | 11/1995 | Hotchkiss et al. | 473/279 |
| 5,549,522 | A | * | 8/1996 | Chang | 473/279 |
| 5,603,334 | A | | 2/1997 | Sharp | |
| 5,613,690 | A | | 3/1997 | McShane et al. | |
| 5,627,327 | A | * | 5/1997 | Zanakis | 73/862.042 |
| 5,820,478 | A | * | 10/1998 | Wood et al. | 473/279 |

(Continued)

FOREIGN PATENT DOCUMENTS

WO 9855184 12/1998

*Primary Examiner* — Loan Thanh
*Assistant Examiner* — Victor K Hwang
(74) *Attorney, Agent, or Firm* — Dorsey & Whitney LLP

(57) ABSTRACT

A balance board including a standing platform connected to a pivot ball. The standing platform provides an area for a subject to stand and can be moved by a set of deflector actuators. The deflector actuators can move the platform in both the lateral and vertical directions. A braking assembly is connected to the ball and the braking assembly increases or decreases rotation resistance to the ball. When resistance is increased to the ball, resistance to rotation for the platform is increased.

17 Claims, 5 Drawing Sheets

(56) References Cited

U.S. PATENT DOCUMENTS

| | | | | |
|---|---|---|---|---|
| 5,830,158 | A * | 11/1998 | Zanakis | 600/595 |
| 5,919,150 | A * | 7/1999 | Zanakis | 600/595 |
| 6,176,817 | B1 * | 1/2001 | Carey et al. | 482/146 |
| 6,315,695 | B1 | 11/2001 | Follett et al. | |
| 6,514,152 | B1 * | 2/2003 | Huang et al. | 473/279 |
| 6,624,802 | B1 | 9/2003 | Klein et al. | |
| 6,659,881 | B2 * | 12/2003 | Lee | 473/279 |
| 6,846,270 | B1 * | 1/2005 | Etnyre | 482/6 |
| 6,916,276 | B1 | 7/2005 | Robinson | |
| 7,004,895 | B2 * | 2/2006 | Perry et al. | 482/146 |
| 7,008,360 | B1 | 3/2006 | Smith | |
| 7,115,078 | B1 * | 10/2006 | Kalember et al. | 482/117 |
| 7,465,253 | B2 | 12/2008 | Perry et al. | |
| 7,727,117 | B2 * | 6/2010 | Feldman et al. | 482/8 |
| 7,892,154 | B1 * | 2/2011 | Alexa | 482/112 |
| 8,206,267 | B2 * | 6/2012 | Holden et al. | 482/4 |
| 2002/0128084 | A1 * | 9/2002 | Lee et al. | 473/132 |
| 2008/0242521 | A1 * | 10/2008 | Einav | 482/110 |
| 2008/0280740 | A1 * | 11/2008 | Knecht et al. | 482/146 |

* cited by examiner

BALANCE THERAPY SYSTEM

CROSS-REFERENCE TO RELATED APPLICATIONS

This application claims benefit under 35 U.S.C. §119(e) of U.S. Provisional Patent Application Ser. No. 61/168,339 titled "Therabalance," filed on Apr. 10, 2009, which is incorporated herein in its entirety.

BACKGROUND

I. Technical Field

The present invention relates generally to therapy devices and more particularly to devices for balance rehabilitation.

II. Background Discussion

People who have suffered severe brain trauma or have other brain/muscular diseases, such as cerebral palsy or multiple sclerosis have difficulty with motor function, for example muscle control and balance. Physical therapy can help reduce the effect of some of the symptoms, as well as improve a patient's motor function. For example, physical exercise and stretching can help people with cerebral palsy to increase muscle control and balance, as well as develop better control over involuntary muscle movements. Therefore, there is a need in the art for a tool that can help patients with mechanical or muscular difficulties to improve their balance and physical control.

SUMMARY

Embodiments of a balance board include a platform operatively connected to a ball, the ball is configured to rotate within a socket. The platform can be selectively deflected in the horizontal and vertical directions by a set of supports, additionally when the platform is deflected it can rotate, as the ball rotates within the socket. The balance board also can include at least one brake pad that can selectively increase or decrease resistance on the ball, as the ball rotates within the socket. As resistance to the ball increases, resistance to the standing platform movement increases; and as resistance to the ball decreases, resistance to the standing platform movement decreases.

Other embodiments of the disclosure include an exercise system having a balance board and a computer electrically connected to the balance board. The balance board can include a standing platform including a ball connected to the standing platform. Rotation of the standing platform rotates the ball, and preventing the ball from rotating prevents the standing platform from rotating. A braking assembly can be configured to selectively prevent the ball from rotating, and thus selectively prevent the standing platform from rotating. The supports can variably apply a force to the standing platform, rotating and deflecting the standing platform.

Still other embodiments of the disclosure include a method of improving muscular function for a subject. The method comprises, providing a balance board having a standing platform that rotates on a ball within a socket, providing a deflector assembly to selectively rotate and deflect the platform and provide a braking system for the ball, such that braking the ball increases the resistance to the platform movement. Signaling the deflector assembly to provide a first force to the platform. Placing a subject on the platform, measuring the subject's force in the subject's attempt to return the platform to a first location. Additionally, placing a subject on the platform and then signaling the deflector assembly to provide another force to the platform and have the subject react to the deflection of the platform.

BRIEF DESCRIPTION OF THE DRAWINGS

The use of the same reference numerals in different drawings indicates similar or identical items.

DETAILED DESCRIPTION OF THE INVENTION

Figure 1A:
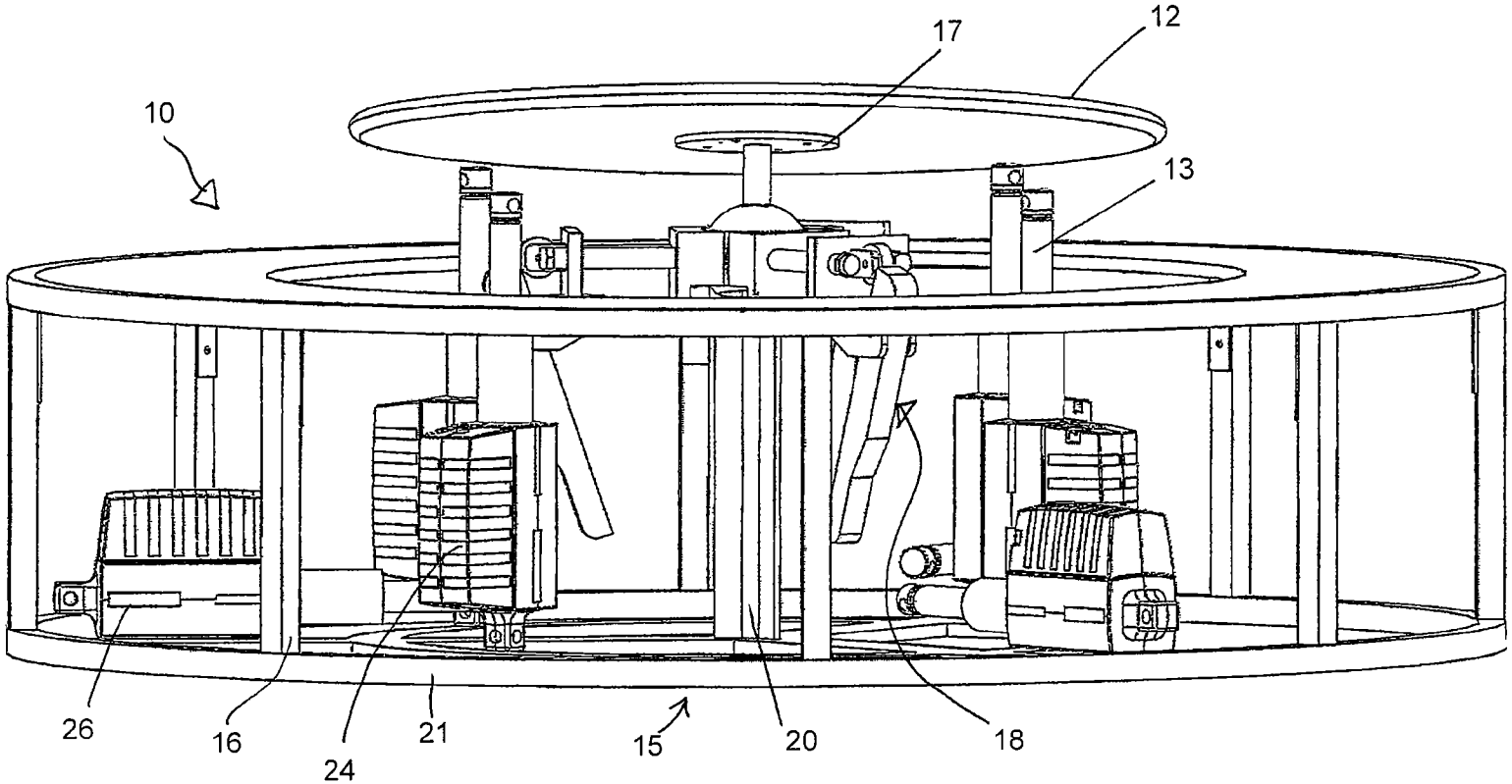
FIG. 1A is a right side view of a balance platform in accordance with some embodiments of the invention.

A balance system that can be used to increase motor and balance skills is disclosed. In some embodiments, the balance system includes a balance platform in communication with a computer system. The balance system in some embodiments, includes a standing platform supported by a central support. The standing platform can be rotated, angled and set to a variety of positions. The standing platform rotates on a ball within a socket and can be deflected in a variety of directions via actuators that act on the standing platform. Braking can be achieved through brake actuators including brake springs and pads acting on the ball within the ball and socket joint. The brake actuators and the deflection actuators can be individually controlled and set to specific levels. In some embodiments, the deflection actuators can be set to angle the standing platform at a particular angle, and the brake actuators can be set to provide a set level of resistance to movement of the standing platform in particular directions. These embodiments allow a therapist to evaluate a patient's ability to balance using specific muscles, and focus on the rehabilitation of certain muscles versus others.

In some embodiments the braking system and the actuators can be supported by a frame. Additionally, the frame can support a subject platform. The subject platform provides an area for a subject to stand before stepping onto the standing platform. The subject platform can additionally be provided with a handrail or other type of guide rail for the subject.

In other embodiments, a computer system can be coupled with the balance platform. In these embodiments, the therapist can electronically control each brake actuator and platform actuator (i.e. set the resistance for the platform movement or set the angle of deflection for the standing platform). Additionally, the braking system can be calibrated such that if the brake pads wear down the acting force on the pads may be increased, thus providing a consistent level of braking (although the pads are worn). Further, the computer system can store data specific to each patient, such that a therapist can track a patient's progress throughout the entire therapy process.

One skilled in the art will understand that the following description has broad application. For example, while embodiments disclosed herein can focus on a balance platform for physical therapy or rehabilitation, it should be appreciated that the concepts disclosed herein equally apply to other types of training or treatment, such as to increase athletic responses or heal/prevent physical injuries. Further-more, while embodiments disclosed herein can focus on actuators for displacement and resistance, other types of displacement and braking techniques/apparatuses can be used. Also, for the sake of discussion, the embodiments disclosed herein can tend to focus on therapy sessions including a patient and a doctor/therapist; however, these concepts apply to exercise outside of the therapy and dual person context. Accordingly, the discussion of any embodiment is meant only to be exemplary and is not intended to suggest that the scope of the disclosure, including the claims, is limited to these embodiments.

Figure 1B:
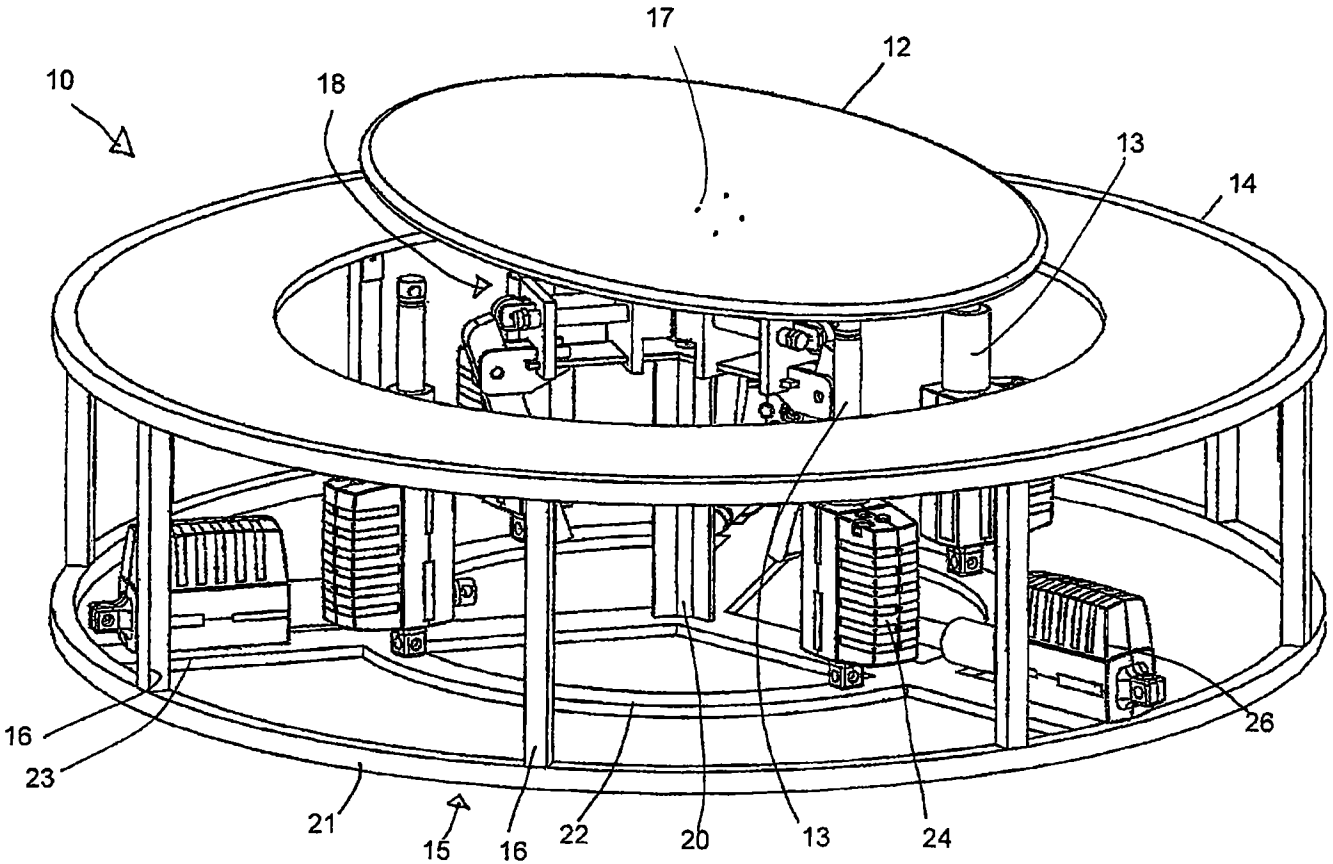
FIG. 1 B is a front perspective view of the balance platform illustrated in FIG. 1A in a deflected position.

FIG. 1A illustrates a side view of an embodiment of the balance board, FIG. 1B illustrates a perspective view of the balance board shown in FIG. 1A in a deflected position. Referring now to FIGS. 1A and 1B, the balance board 10 can include a standing platform 12 supported by a central support 20, the central support 20 can be connected to the standing platform via fasteners 17. The standing platform 12 can be deflected by deflection actuators 13 and can include a braking system 18. The central support 20 is connected to a frame 15, the frame 15 supports a subject platform 14 or walkway, the deflection actuators 13, the platform controllers 24, as well as the braking system 18 and central support 20.

In some embodiments, the standing platform 12 provides an area for the subject or patient to stand while using the balance board 10. The subject stands on the standing platform 12 and can push on different areas of the standing platform 12 in an attempt to deflect the standing platform 12 in a variety of directions. The force required by the subject to deflect the standing platform 12 can be adjusted by increasing the resistance or braking of the braking system 18. In other embodiments, the subject can stand on the standing platform 12 and respond to deflection of the standing platform 12 produced by the deflection actuators. In still other embodiments, the standing platform 12 can be angled by the deflection actuators before the subject steps on to the standing platform 12. The subject can act against the resistance and deflection to angle the standing platform 12 in another direction.

These types of movements by the subject on the standing platform 12 help a patient/subject develop better muscle control, response and balance. For example, if the standing platform 12 is deflected off horizontal level the patient can press against the unbalanced side, to push it back into a horizontal position, this can help to build up muscle control in the patient. Additionally, as the resistance of the standing platform 12 can be adjusted, the difficulty level can be increased as the patient's muscle control advances.

The standing platform 12 in some embodiments is substantially circular in shape, however in other embodiments, the standing platform 12 can be other shapes, such as square, rectangular, and the like. The standing platform 12 in various embodiments can be constructed out any other material suitable for supporting a person, for example, aluminum, steel, alloys, plastic, wood, or the like. Additionally, in some embodiments, the standing platform 12 can include a coating on top of the material. For example, the coating can be a non-slip plastic, grip tape, or sticky coating to provide better traction for the subject.

Turning again to FIGS. 1A and 1B, the standing platform 12 is operatively associated with the frame 15 via the central support 20, which supports the standing platform 12. The frame 15 provides support to the standing platform 12, the braking system 18, the deflection actuators 13, as well as the deflection controllers 24 and the braking controllers 26. The frame 15 includes outer support bars 16 connected to a lower support ring 21, the outer support bars 16 provide support for the subject platform 14. The lower support ring 21 further includes floor support bars 22, 23, which rest on the ground beneath the balance board 10. The floor support bars 22, 23 also provide attachment locations for the deflection controllers 24, as well as the brake controllers 26. The floor support bars 22, 23 also can be connected to the central support 20. In some embodiments, the frame 15 can be constructed out of 1 inch aluminum bars, however in other embodiments the frame 15 can be constructed out of any other durable material, such as steel, alloys, plastic, and the like.

The subject platform 14 provides an area for the subject to stand before and after stepping on the standing platform 12. The subject platform 14 can be constructed out of similar materials to the standing platform 12 and some embodiments can include an exterior coating for the material as well. The subject platform 14 can be restricted from movement by the support bars 16, as it provides a stable area for a subject to stand. In some embodiments, a handrail (not illustrated) can be secured to the subject platform 14. For example, a handrail can be placed on an outer circumference of the subject platform or on the inner circumference of the subject platform 14, or both locations. These embodiments provide a place of a subject to grab on to in order to support himself, while on the subject platform 14, or on the standing platform 12. The subject platform 14 can be shaped to essentially conform to the shape of the standing platform 12, and in some embodiments, the subject platform 14 can be circular shaped. However, in other embodiments, the subject platform 14 can be shaped in a different shape from the standing platform 12.

The deflection actuators 13 can be configured to deflect the standing platform 12 in the lateral and vertical directions, and in some cases the deflection actuators 13 can deflect the standing platform 12 in both the lateral and vertical directions concurrently. In some embodiments, the deflection actuators 13 act on a bottom side of the standing platform 12, and can push upwards on the standing platform 12 to deflect it upwards or can be lowered (while other deflection actuators 13 can be raised) to lower the standing platform 12 in some directions. For example, in some embodiments the deflection actuators 13 can move from 0 to 25 degrees of deflection, and can allow for motion in the lateral and vertical directions either separately or at the same time. The deflection actuators 13 can be positioned such that when the standing platform 12 is deflected in some angles, some of the actuators may not be in contact with the standing platform 12. This can be possible, as in some embodiments, the standing platform 12 may be supported only by the central support 20, such that the deflection actuators 13 may not provide structural support for the standing platform 12. In some embodiments, the deflection actuators 13 can be separated from each other deflection actuator 13 by 90 degrees, however it should be noted that the deflection actuators 13 can be separated by other distances as well.

The deflection actuators 13 in some embodiments can be limiter actuators. In other embodiments the deflection actuators 13 can be attached to supports/legs that act on the standing platform 12, such that the deflection actuators 13 act on the supports (i.e. displacing the supports in a certain direction) and then each support can in turn act on the standing platform 12. Additionally, each deflection actuator 13 can produce an electric signal indicating its respective displacement.

The deflection actuators 13 can be controlled by deflection controllers 24. For example, in some embodiments, the deflection controllers 24 can raise and lower each deflection actuator 13. In some embodiments, the deflection controllers 24 can raise and lower each deflection actuator 13 by providing varying electrical signals to each deflection actuator 13.

The deflection controllers 24 house electrical components for each deflection actuator 13, and the deflection controllers 24 can be electrically connected to a computer system. Although each deflection actuator 13 has been illustrated with its own deflection controller 24, there can be other embodiments, for example, there can be a singular deflection controller 24 for all the deflection actuators 13. In these embodiments, the deflection controller 24 can control every deflection actuator 13. Further, the deflection actuators 13 and the deflection controllers 24 can include sensors, such as sonar sensors, or the like to detect the position/deflection changes of each actuator 13. These embodiments allow for a therapist, subject or doctor to be able to determine (and monitor) the deflection angle and amounts for each actuator 13.

Figure 2:
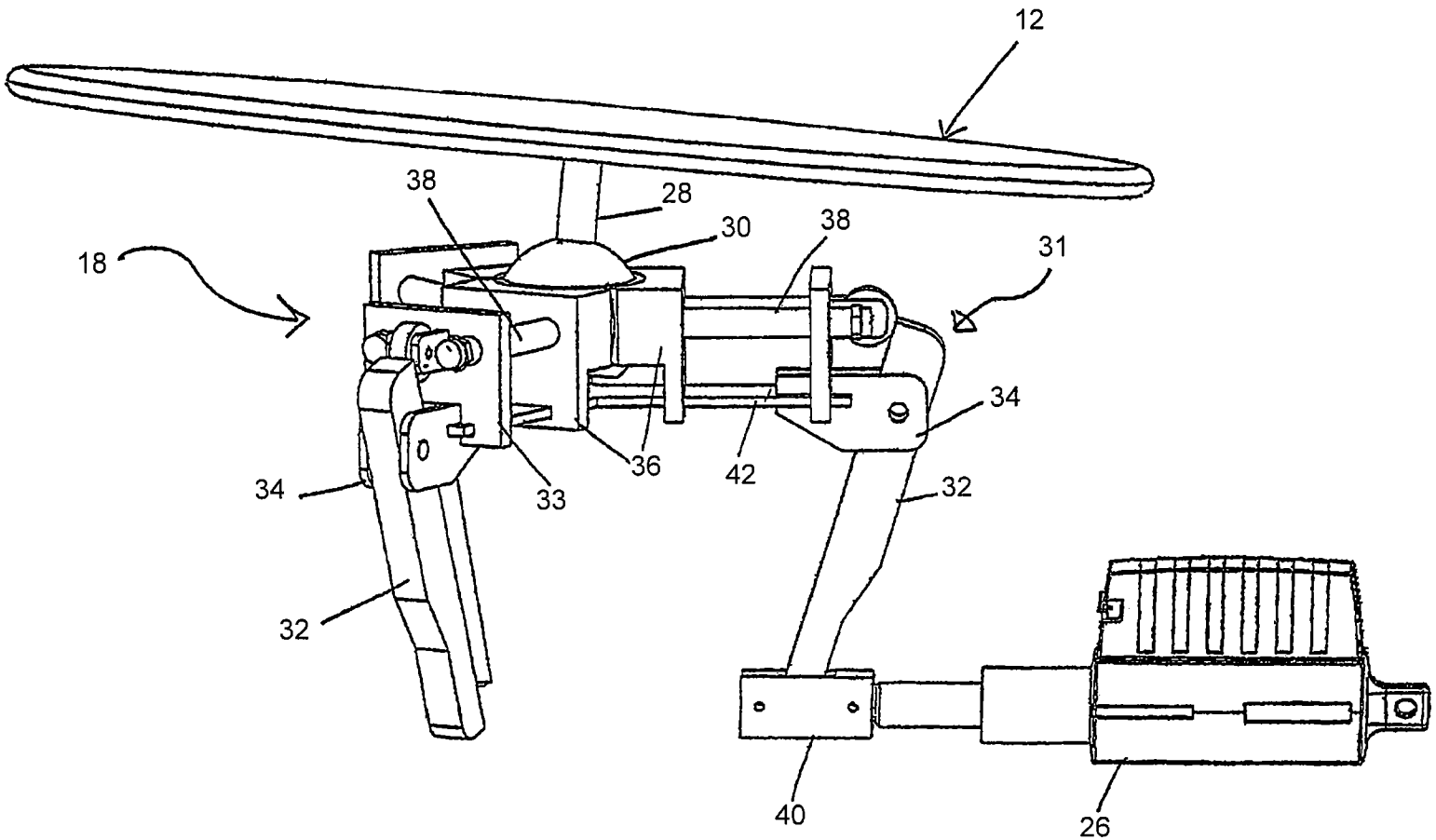
FIG. 2 is a left perspective view of some embodiments of a braking system of the balance platform removed from the inner structure and subject platform of the balance platform.
Figure 3:
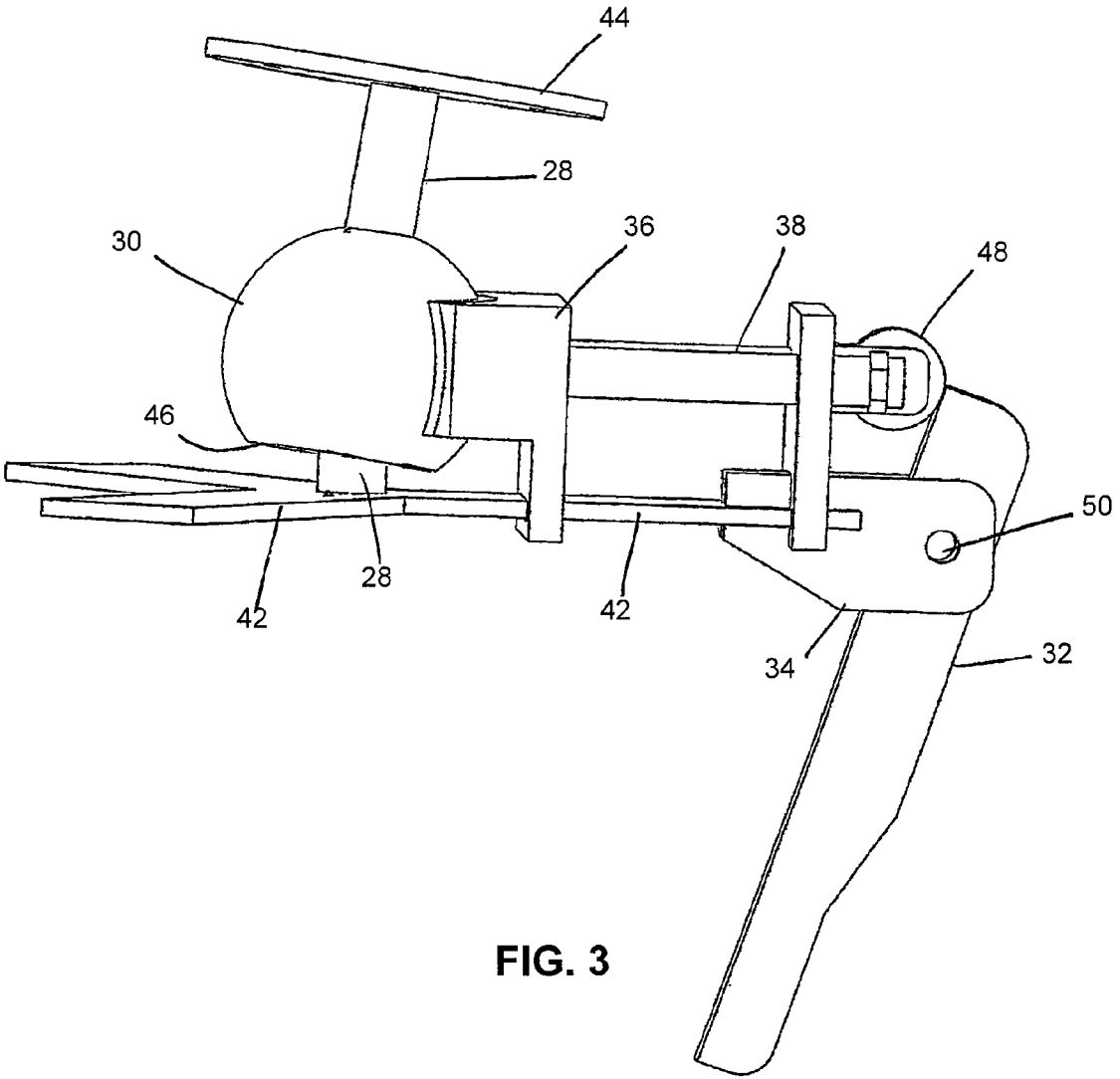
FIG. 3 is an enlarged perspective view of one braking assembly of the braking system illustrated in FIG. 2.

FIG. 2 illustrates the braking system 18 attached to the standing platform 12, removed from the frame 15 and the subject platform 14. FIG. 3 illustrates an enlarged view of one brake assembly 31. Referring now to FIGS. 1, 2 and 3, the standing platform 12 can rotate via a ball 30, the standing platform 12 is connected to the ball 30 by a ball support rod 28 and a support plate 44. The support rod 28 also can connect at a bottom portion of the ball 30 the support 42. As the deflection actuators 13 act on the standing platform 12 to displace it in the horizontal or vertical directions, the ball 30 rotates within a socket or joint created by the braking assemblies 31. The ball 30 allows the standing platform 12 to rotate in a number of directions, while providing stability for the standing platform 12.

The ball 30 can include a flat bottom 46, in order to allow the support rod 28 to connect to the support 42. In some embodiments, the support rod 28 carries most of the vertical load of the standing platform 12. In these embodiments, the ball 30 can also have a larger range of motion (than a rounded bottom), as the ball 30 can deflect to steeper angles because the bottom 46 of the ball 30 can better avoid hitting the support 42. In some embodiments, the ball 30 can be constructed out of steel, however in other embodiments the ball 30 can be constructed out of similarly strong materials, such as steel alloys, and the like. Additionally, in some embodiments the ball 30 can be substantially hollow. Further, there can be a coating included on the outside surface of the ball 30. These embodiments, can increase or decrease the resistance of the standing platform 12, i.e. by increasing or decreasing the friction on a surface of the ball 30.

The ball braking assemblies 31 create a socket or joint for the ball 30 to rotate, the braking assemblies 31 are attached to the center support 20 by support 42. The support 42 can be secured to the central support 20, the support 42 connects the braking assemblies 31 to the balance board 10 system. In some embodiments, there can be three braking assemblies 31 spaced around the ball 30. In these embodiments, the braking assemblies 31 can be spaced 120 degrees apart from each other. However, in other embodiments, there can be fewer or more braking assemblies 31 spaced in any manner, depending on the size of the ball 30 or the desired level of braking control. As illustrated in FIG. 3, the support 42 can be formed as a singular piece and include a prong or leg for each braking assembly 31. In some embodiments, there can be three legs, such that the support 42 forms a "Y" shape. The braking assemblies 31 can additionally be connected to the floor support bars 22, 23.

Referring now to FIGS. 2 and 3, each braking assembly 31 can include a brake pad 36, a brake pad rod 38, a lever arm 32, a connection bracket 33, connection fasteners 34, 40, and a brake controller 26. The brake pads 36 can be controlled by each respective brake controller 26. For example, the brake controller 26 provides a signal or force to the lever arm 32 and the lever arm 32 pushes (or pulls) the brake pad rod 38. The brake pad rod 38 subsequently applies or reduces force to springs (not shown) and the springs act on the brake pad 36, and the brake pad 36 reacts on the ball 30. In these embodiments, the braking system 18 applies friction (or other braking mechanisms) directly to the ball 30. These embodiments provide predictable resistance and calibration for the balance board 10 system. For example, as each pad 36 can be individually controlled, the standing platform 12 can be calibrated to each subject and easily set to return to a specific resistance. Additionally, the braking system 18 allows for variable resistance within the socket, as applied to the ball 30. The braking system 18, can be configured to provide braking on the ball 30 constant symmetric resistance to the ball 30. Further, the braking system 18 can apply more force to the lever arm 32 if a brake pad 36 begins to wear out. In these embodiments, the life of the braking system 18 can be extended, while maintaining a consistent level of braking force applied to the ball 30. For example, if one brake pad 36 wears down, the force for the pad's lever arm 32 may be increased for a set level of braking on the ball 30, while the other pads 36 (and their lever arms 32) may remain the same. Similarly, if the brake pads 36 have all worn consistently, the force for each pad 36 may be increased to maintain a consistent level of braking.

The brake pads 36 apply a force to the ball 30 in order to slow it down or stop it completely. For example, by increasing or decreasing the pressure applied to the ball 30 the brake pads 36 can completely stop the ball 30 from rotating in a certain direction. Further, the brake pads 36 may apply uniform symmetrical resistance to either a horizontal or vertical rotation axis of the ball 30. In some embodiments, the brake pads 36 can be curved to substantially follow the shape of the ball 30. These embodiments, allow the brake pads 36 to better be able to stop movement of the ball 30, as the entire pad 36 can be applied against a surface of the ball 30. The brake pads 36 can be constructed out of zinc in some embodiments, but in other embodiments, the pads 36 can be constructed out of any other suitable materials, such as those materials having strong coefficients of friction, or other materials including a coating to increase the coefficient of friction. Further, each pad 36 as well as each brake pad rod 38 can include sensors to indicate the amount of friction applied to the ball 30, as well as the amount of deflection of the brake controller 26. These embodiments allow the balance board 10 system to alert a subject (via a computer display) that the braking system 18 can be worn out.

The brake pad rod 38 can contain springs to increase or decrease force applied to the brake pads 36. In these embodiments, the springs may be used to gradually apply/reduce force to the brake pads 36. However, in other embodiments, the brake pad rod 38 can apply a force directly to the brake pads 36, i.e. the springs can be omitted. Additionally, there can be multiple brake pad rods 38 for each brake pad 36, these embodiments distribute the force from the springs and/or lever arm 32 throughout the entire brake pad 36. The brake pad rod 38 can connect to a lever arm 32 at a hinge 48 located at a top portion of the lever arm 32. The hinge 48 can be configured to secure the brake rod arm 38 to the lever arm 32, while still allowing the lever arm 32 to rotate with respect to the brake rod 38. Similarly, the lever arm 32 can be connected at a connection point 50 to the support 42, the support 42 can connect to an attachment piece 34, which can then attach to the lever arm 32.

The lever arm 32 provides a force to the brake pad rod 38 in order to increase the movement resistance of the standing platform 12. For example, if a subject wishes to increase the difficulty of deflecting the standing portion 12 in a certain direction, the lever arm 32 can be used to increase the resistance on the ball 30 in that direction. The lever arm 32 can be connected (via a fastener 40) to a brake controller 26. Thus, the lever arm 32 can be configured to respond to electrical or mechanical signals from the brake controller 26, and move the brake pad rod 38 accordingly. The brake controllers 26 can be brake actuators, that displace according to a signal. In these embodiments the brake controllers 26 can pull the brake pad control rods 38 away from the brake pad 36 (and away from the ball 30) to decrease the amount of braking and displace towards the ball 30 (i.e. towards a center of the balance board 10) to increase the force on the brake pad 36, thus increase the braking of the standing platform 12.

Similar to the deflection actuators 13 and deflection controllers 24, there can be sensors located at on the brake controllers 26, as well as the lever arm 32 and/or the brake pads 36. These embodiments, provide data regarding displacement, and resistance of the braking system 18. This allows for a subject/therapist to calibrate the braking system 18, monitor the resistance applied to the ball 30, as well as determine whether the braking system 18 may be worn out. The sensors can be sonar displacement sensors, position sensors, force sensors, and the like.

Figure 4:
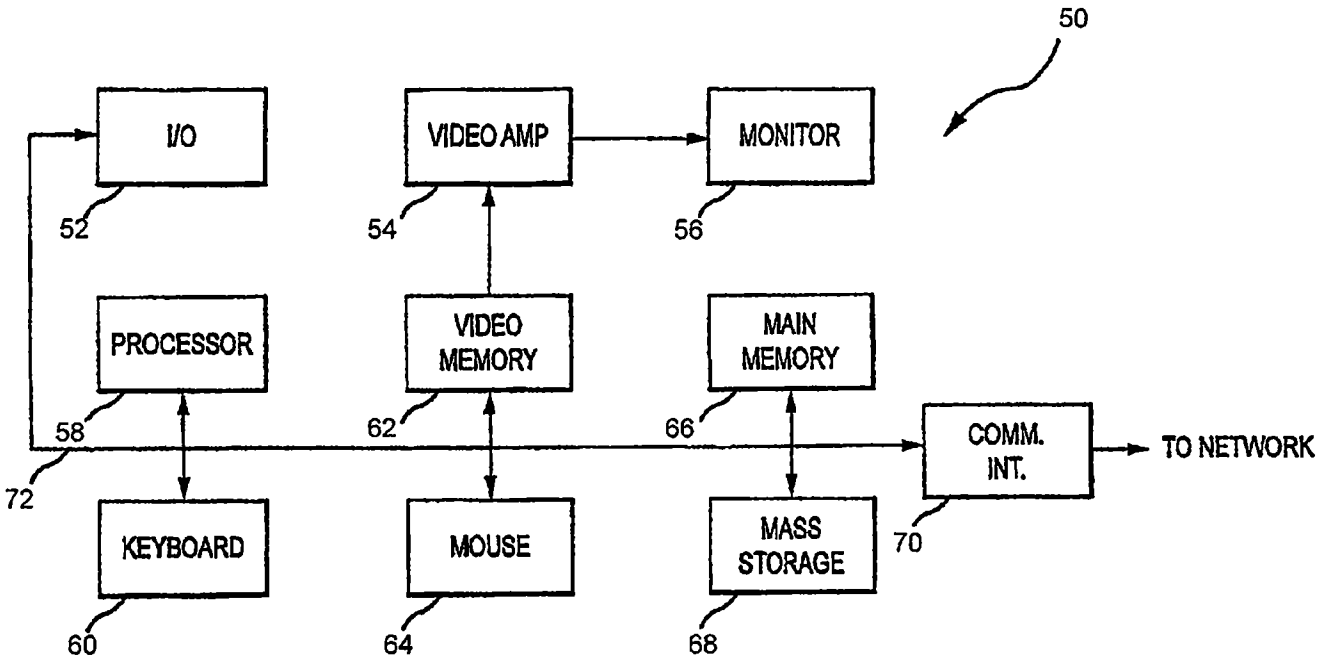
FIG. 4 illustrates an example of the computer system to be used with the balance platform illustrated in FIG. 1A.

FIG. 4 illustrates an embodiment of the computer system 50 that can be used in conjunction with the balance board 10. In some embodiments, the deflection actuators 13 and the braking system 18 can be monitored and controlled via the computer system 50. For example, the braking system 18 can provide electronic signals indicating the amount of braking force applied to the ball 30. Similarly, the amount of force applied by the braking system 18 may be controlled by a doctor/therapist via the computer system 50.

In some embodiments, the computer system 50 is capable of storing and/or processing signals, such as to receive signals from the balance board 10 system, process those signals to display related information in terms of the standing platform displacement 12, resistance, and the like. In these embodiments, a therapist (or other subject) can read real-time position and resistance displays produced by the balance board 10. Similarly, the computer system 50 can be used to communicate positions to the balance board 10. In these embodiments, the therapist (or other computer system 50 subject) can set the position of each deflection actuator 13 (and in turn set the position of the standing platform 12), as well as set the resistance level of the standing platform 12. The computer system 50 can also be used to track patient progress as well as compare different patients/subjects.

In some therapy treatments, the therapist can configure the deflection actuators 13 to deflect the standing platform 12 to a certain angle or tilt. Once the standing platform 12 has been tilted, the subject can mount onto the standing platform 12. The therapist can then measure the time it takes the subject to reach a balanced state while standing on the tilted standing platform 12. The balanced state for the subject may be maintaining a level position on the standing platform 12. The subject's time may be recorded (i.e. the time it takes for the subject to reach a balanced position). The time can then be compared against other patients' times, previous times by the subject, or other data. The goal for the subject can be to reach a balance state in a minimum amount of time, and the therapist can (via the computer 50) chart and store the balance time for each session.

Other therapy treatments can involve starting the standing platform 12 in a horizontal (i.e. not deflected) position and the therapist can then have the subject mount the standing platform 12. The therapist can then deflect the standing platform 12, with the object to measure the subject's ability to balance while the platform has different degrees of deflection. It should be noted that there are multiple types of treatments available and these previous examples are just certain instances of how the balance board 10 and computer 50 system can be used in combination to evaluate and improve a subject's balance and muscle function.

Referring again to FIG. 4, in some embodiments, the computer system 50 can be an implementation of enterprise level computers, such as one or more servers. In other embodiments, the computer system 50 can be a personal computer and/or a handheld electronic device. A keyboard 60 and mouse 64 can be coupled to the computer system 50 via a system bus 72. The keyboard 60 and the mouse 64, in one example, can introduce subject input to the computer system 50 and communicate that subject input to a processor 58. Other suitable input devices can be used in addition to, or in place of, the mouse 64 and the keyboard 60. An input/output unit 52 (I/O) coupled to the system bus 72 represents such I/O elements as a printer, audio/video (A/V) I/O, etc. Further, the balance board 10 system can be coupled to the computer system 50 via the input/output unit 52. In these embodiments, the sensors located throughout the balance board 10 can provide feedback to be processed by the processor 58.

In other embodiments, the balance board 10 can additionally include an additional computer system 50 in order to process the data signals directly. In other embodiments, the balance board 10 can include a processor or microcontroller for receiving signals from the various sensors and communicating them (via the input/output unit 52) to the computer system 50.

Computer 50 also can include a video memory 62, a main memory 66 and a mass storage 68, all coupled to the system bus 72 along with the keyboard 60, the mouse 64 and the processor 58. The mass storage 68 can include both fixed and removable media, such as magnetic, optical or magnetic optical storage systems and any other available mass storage technology. The bus 72 can contain, for example, address lines for addressing the video memory 62 or the main memory 66.

The system bus 72 also can include a data bus for transferring data between and among the components, such as the processor 58, the main memory 66, the video memory 62 and the mass storage 68. The video memory 62 can be a dual-ported video random access memory. One port of the video memory 62, in one example, is coupled to a video amplifier 54, which is used to drive a monitor 56. The monitor 56 can be any type of monitor suitable for displaying graphic images, such as a cathode ray tube monitor (CRT), flat panel, or liquid crystal display (LCD) monitor or any other suitable data presentation device.

The computer system includes a processor 58, which can be any suitable microprocessor or microcomputer. The computer system 50 also can include a communication interface 70 coupled to the bus 72. The communication interface 70 provides a two-way data communication coupling via a network link. For example, the communication interface 70 can be a satellite link, a local area network (LAN) card, a cable modem, and/or wireless interface. In any such implementation, the communication interface 70 sends and receives electrical, electromagnetic or optical signals that carry digital data streams representing various types of information, such as seismic signals that have been separated from a blended signal and/or blended signals.

Code received by the computer system 50 can be executed by the processor 58 as the code is received, and/or stored in the mass storage 68, or other non-volatile storage for later execution. In this manner, the computer system 50 can obtain program code in a variety of forms. Program code can be embodied in any form of computer program product such as a medium configured to store or transport computer readable code or data, or in which computer readable code or data can be embedded. Examples of computer program products include CD-ROM discs, ROM cards, floppy disks, magnetic tapes, computer hard drives, servers on a network, and solid state memory devices.

Regardless of the actual implementation of the computer system 50, the data processing system can execute operations that allow for the processing and analysis of multiple waveform and seismic signals.

What is claimed is:

1. A balance board comprising:

a braking assembly in electrical communication with a computer, the braking assembly comprising at least one brake pad, wherein the braking assembly is configured to displace the at least one brake pad in at least one direction;

wherein the braking assembly is configured to form a socket;

a ball configured to rotate within the socket;

a platform operatively associated with the ball;

a bottom portion of the platform is operatively associated with a set of supports wherein the set of supports raises and lowers, and when the set of supports lowers and raises, each support acts on the bottom portion of the platform, rotating the ball within the socket; and a deflector actuator operatively associated with the set of supports and in electrical communication with the computer, wherein the deflector actuator selectively applies a force to the set of supports.

2. The balance board of claim 1, wherein the set of supports comprises at least one support sensor configured to detect displacement of the each support within the set of supports with respect to a first location;

wherein the at least one support sensor is in electrical communication with the computer.

3. The balance board of claim 1, wherein the braking assembly further comprises a brake sensor configured to detect displacement of the at least one brake pad with respect to a first location; and wherein the brake sensor is in electrical communication with the computer.

4. The balance board of claim 1, wherein the braking assembly further comprises a braking actuator operatively associated with the at least one brake pad, wherein the braking actuator selectively applies a force to the at least one brake pad.

5. The balance board of claim 4, wherein the braking assembly further comprises a lever arm operatively connected between the braking actuator and the at least one brake pad, wherein the braking actuator selectively applies a force to the lever arm and the lever arm applies the force to the at least one brake pad.

6. The balance board of claim 1, further comprising a support structure operatively associated with the set of supports and the braking assembly.

7. The balance board of claim 6, wherein the support structure is 1 inch aluminum bars and the ball is steel.

8. The balance board of claim 1, wherein the braking assembly comprises a first braking assembly, a second braking assembly and a third braking assembly.

9. The balance board of claim 8, wherein the at least one brake pad comprises a first brake pad operatively associated with the first braking assembly;

a second brake pad operatively associated with the second braking assembly; and a third brake pad operatively associated with the third braking assembly.

10. An exercise system comprising a balance board according to claim 1, further comprising at least one support sensor configured to detect displacement of each support within the set of supports with respect to at least one location;

at least one brake sensor configured to detect displacement of the at least one brake pad with respect to at least one location; and the computer electrically connected to the at least one support sensor and the at least one brake sensor.

11. The exercise system of claim 10, wherein the set of supports is in electrical communication with the computer and the computer is configured to selectively raise and lower the set of supports; and the braking assembly is in electrical communication with the computer and the computer is configured to selectively activate the at least one brake pad.

12. The exercise system of claim 11, wherein the at least one brake pad may be selectively activated to increase a force applied to the brake pad to maintain a consistent level of braking force.

13. A method of improving muscular function comprising:

placing a subject on a standing platform of the balance board according to claim 1;

signaling the set of supports to provide a first force to the standing platform;

deflecting the standing platform from an original position in at least one direction; and measuring a first time amount it takes for the subject to regain balance after the standing platform has been deflected.

14. The method of improving muscular function of claim 13, further comprising:

removing the subject from the standing platform;

returning the standing platform to the original position;

deflecting the standing platform to a second position;

placing the subject on the standing platform; and measuring a second time amount it takes for the subject to balance on the deflected standing platform at the second position.

15. The method of claim 14, further comprising:

storing the first time amount;

storing the second time amount; and comparing the first time amount to a first predetermined time length and second time amount to a second predetermined time length.

16. A balance board comprising:

a braking assembly comprising at least one brake pad, wherein the braking assembly is configured to displace the at least one brake pad in at least one direction;

wherein the braking assembly is configured to form a socket;

a ball configured to rotate within the socket;

a platform operatively associated with the ball;

a bottom portion of the platform is operatively associated with a set of supports wherein the set of supports raises and lowers, and when the set of supports lowers and raises, each support acts on the bottom portion of the platform, rotating the ball within the socket; and, wherein the set of supports comprises four supports.

17. The balance board of claim 16, wherein each of the four supports raises and lowers independent of the other supports.

* * * * *